US006405388B1

(12) United States Patent
Brown

(10) Patent No.: US 6,405,388 B1
(45) Date of Patent: Jun. 18, 2002

(54) SINK AND DRAINED AREA ASSEMBLY AND METHOD OF CONSTRUCTION

(76) Inventor: Jed H. Brown, 136 S. 121st St., Omaha, NE (US) 68154

( * ) Notice: Subject to any disclaimer, the term of this patent is extended or adjusted under 35 U.S.C. 154(b) by 0 days.

(21) Appl. No.: 09/658,549

(22) Filed: Sep. 8, 2000

Related U.S. Application Data

(60) Provisional application No. 60/153,435, filed on Sep. 10, 1999.

(51) Int. Cl.[7] ..... A47K 3/03

(52) U.S. Cl. ..... 4/619; 4/612; 4/663; 4/553; 52/79.1

(58) Field of Search ..... 4/619, 663, 597, 4/612, 546, 552–554; 52/79.1

(56) References Cited

U.S. PATENT DOCUMENTS

| | | | | | |
|---|---|---|---|---|---|
| 1,457,470 | A | * | 6/1923 | Steinkamp | 4/554 |
| 2,229,060 | A | * | 1/1941 | Druckenmiller | 4/553 |
| 3,955,219 | A | * | 5/1976 | Finch et al. | 4/552 |
| 4,221,441 | A | * | 9/1980 | Bain | |
| 4,788,802 | A | * | 12/1988 | Wokas | |
| 4,862,527 | A | * | 9/1989 | McAllister | 4/612 |

FOREIGN PATENT DOCUMENTS

| | | | | |
|---|---|---|---|---|
| CH | 366367 | * | 2/1963 | 4/553 |
| JP | 2-38632 | * | 2/1990 | 4/546 |

* cited by examiner

*Primary Examiner*—Charles R. Eloshway
(74) *Attorney, Agent, or Firm*—Philip J. Lee

(57) ABSTRACT

A wash sink and drained area assembly and method of construction comprise a wash sink assembled in immediate and lateral proximity to an enclosable and drained floor area with racks provided for drying items and a retractable curtain across the front edge of the drained area, the assembly formed as a single unit suitable for installation in a residential utility room.

8 Claims, 5 Drawing Sheets

SINK AND DRAINED AREA ASSEMBLY AND METHOD OF CONSTRUCTION

CROSS REFERENCE TO RELATED PROVISIONAL APPLICATION

This application claims the benefit of U.S. Provisional Application No. 60/153,435, filed Sep. 10, 1999.

BACKGROUND OF THE INVENTION

A. Field of Invention

The present invention relates generally to household fixtures and more particularly to a wash sink and drained area assembly having a wash sink assembled in proximity to an enclosable and drained floor area, and the method of construction thereof.

B. Description of Related Art

Several designs of one piece or integrated sink and shower or tub assemblies have been designed for providing a compact and convenient facility for personal hygiene. For example, U.S. Pat. Nos. D110,643, 2,084,793, 2,198,605, 2,438,665, 3,600,720, 4,718,131, and 4,653,128 all describe sanitary facilities in which a sink and shower are combined in a single fixture unit. While these types of fixture units may be useful for personal hygiene, they are not designed for utility purposes such as clothes washing, pet bathing, air or drip-drying wet items, plant misting, and or cleaning large items such as muddy footwear. While many modern home designs provide for utility or "mud" rooms, the usefulness of such rooms is limited by the facilities available. Commonly available utility sinks are not sufficient for cleaning large or extremely dirty items, pets or children. Drained areas for drying garments or other wet items are not used. Therefore, the need remains for a utility unit, which is suited for such utility purposes and can be conveniently and compactly fitted into a mud or utility room of a personal residence. Rather than providing a facility for personal hygiene, such a utility unit would provide features that are not applicable or useful for personal hygiene, except for pets or small children.

While counter level wash sinks for hand laundering of clothes are known, there is a need for adjacent facilities for drying hand washed items by hanging and allowing water to drip off the items. Occasionally washroom areas are designed with a central floor drain, but use of a central floor drain allows the drainage to extend over the floor into areas that may serve as pathways. What is required is an integrated assembly including a wash sink with hand spray attachment in close proximity to a partially enclosable and self contained area with a floor drainage system similar to a shower drain pan and with rods and racks placed for convenient drying of washed or wet items.

SUMMARY OF THE INVENTION

The present invention comprises an assembly comprising, at one end, a wash sink formed at conventional work sink height with appropriate plumbing for a faucet with hot and cold water, and a partially enclosed drained area immediately and laterally adjacent the sink. In the preferred embodiment, the entire fixture body is molded as a single unit of fiber reinforced resin, although other materials, such as plastic, tile or plastic laminates could be substituted with similar results. The unit is configured to be installed in a residential utility room along a wall, and has a front, at which the user stands, and a rear, which abuts the wall when installed. The distance from front to rear is such as will allow comfortable arm's length access to items in the rear. The sink section comprises a faucet and flow control devices for hot and cold water as well as a sprayer attachment with a flexible and preferably retractable hose, which is long enough to reach the far end of the drained area. The sprayer nozzle is preferably adapted for flow control to provide a high velocity spray, which may be adjustable for velocity, volume and/or pattern. In the preferred embodiment, the drained area is located to the right, viewing the unit from front to rear, for the convenience of right hand dominant users; however, the relative positions of the sink and drained areas could be reversed if desired. The drained area comprises a drain pan with a central drain and a pan floor sloping toward the drain. An outer lip extends upward from the floor of the pan, the inside surface of the lip forming a shoulder which surrounds the entire drained area to support and surround an open grate suitably strong to bear a user's weight. The unit may be installed with the drain below the level of the floor in the room in which it is installed such that the lip and grate are flush or nearly flush with the room floor. The preferred installation would involve only a slight upward protrusion of the lip above floor level. An alternative installation would place the entire unit above the room floor with the lip significantly elevated above floor level. The choice of installation height may be determined by the user's desires and expected usage and may be influenced by construction convenience as the process of installing the recessed drain pan may require modifications of floor joists.

The wash and drain area unit comprises a vertical and flat rear wall of impervious material as well as two side walls that are also vertical, flat and impervious. One or more series of hook shaped rack supports are mounted on the rear and side walls at convenient heights to support drying racks or to support clothes hung thereon. Each series of hooks comprises three hooks mounted on the rear wall and two hooks mounted on each side wall, all hooks in a series being mounted at the same height. Open grate drying racks extend from at least one side wall hook to the other side wall hook when deployed horizontally, and the racks may be raised to a vertical position flat against the rear wall and resting on the rear wall hooks, or the racks may be completely removed. The unit further comprises one or more retractable clotheslines on the side walls containing a spring loaded line extendable to hooks on the opposing side wall. The drained area is partially enclosable by a retractable curtain. A hinged bar extends horizontally from a hinge fitting on the front of the side wall opposite to the sink, to a releasable support fitting on the side of the sink cabinet, at the front of the unit, parallel to and slightly rearward of the front edge of the drain area lip. A retractable curtain is supported by the bar and extendable the length of the bar and across the front edge of the drained area such that the drained area can be completely enclosed to a height just less than counter height. With the curtain fully deployed, the sprayer can be vigorously used in the drain area without splashing or over spray escaping the drained area. While the height of the curtain may vary according to expected usage, it is anticipated that a height of about thirty inches would be most generally convenient.

The principal aim of the present invention is to provide a sink and drained area assembly which meets the foregoing requirements and which is capable of providing a comfortable and convenient residential utility facility.

Another and further object and aim of the present invention is to provide a sink and drained area assembly which meets the foregoing requirements and which is capable of being economical to manufacture and install.

Other objects and advantages of the invention will become apparent from the Description of the Preferred Embodiment and the Drawings and will be in part pointed out in more detail hereinafter.

The invention consists in the features of construction, combination of elements and arrangement of parts exemplified in the construction hereinafter described and the scope of the invention will be indicated in the appended claims.

DESCRIPTION OF THE PREFERRED EMBODIMENT

Figure 1:
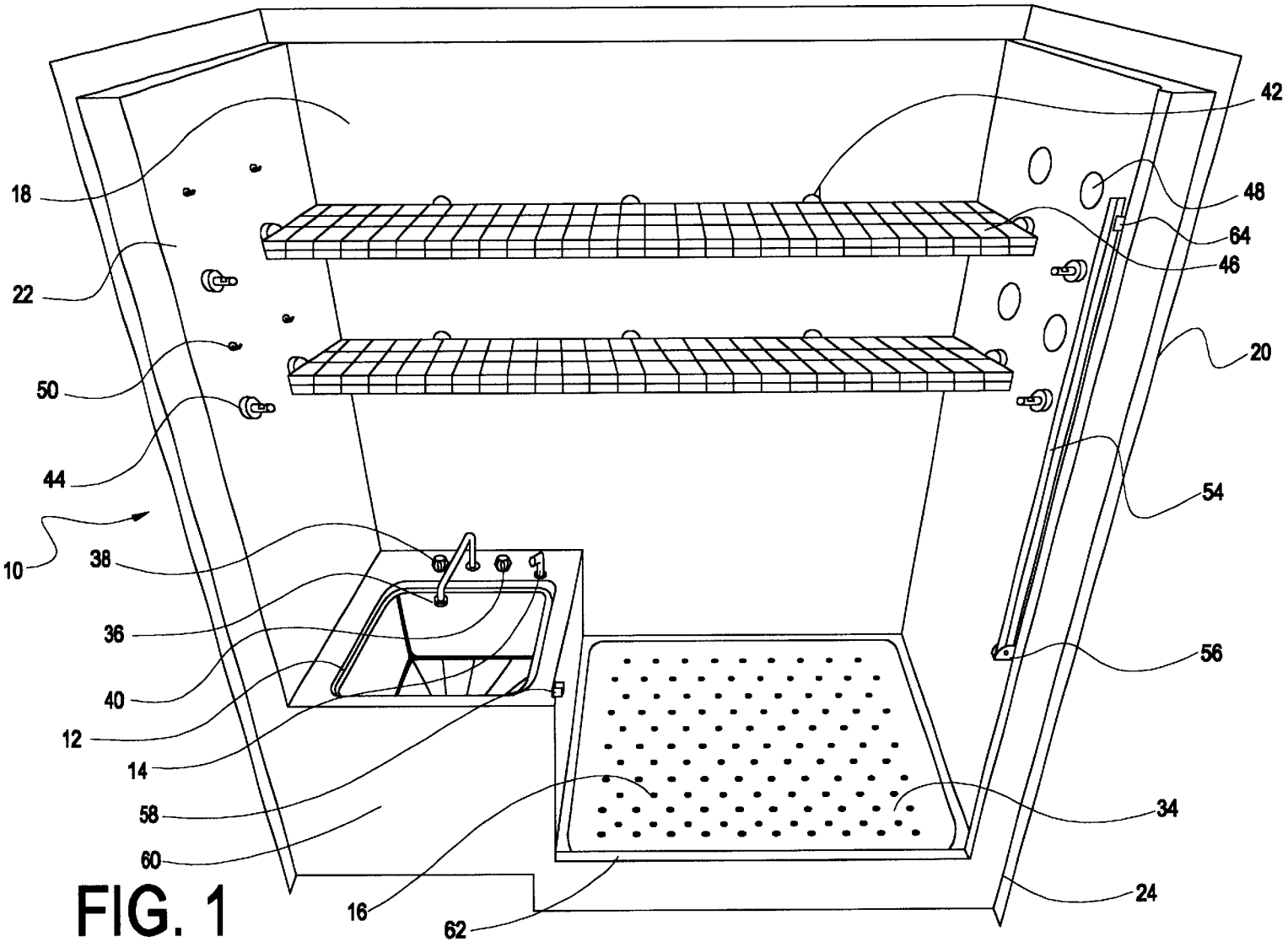
FIG. 1 is a front perspective view of a preferred embodiment of the invention showing the sink and drain assembly of the present invention.
Figure 2:
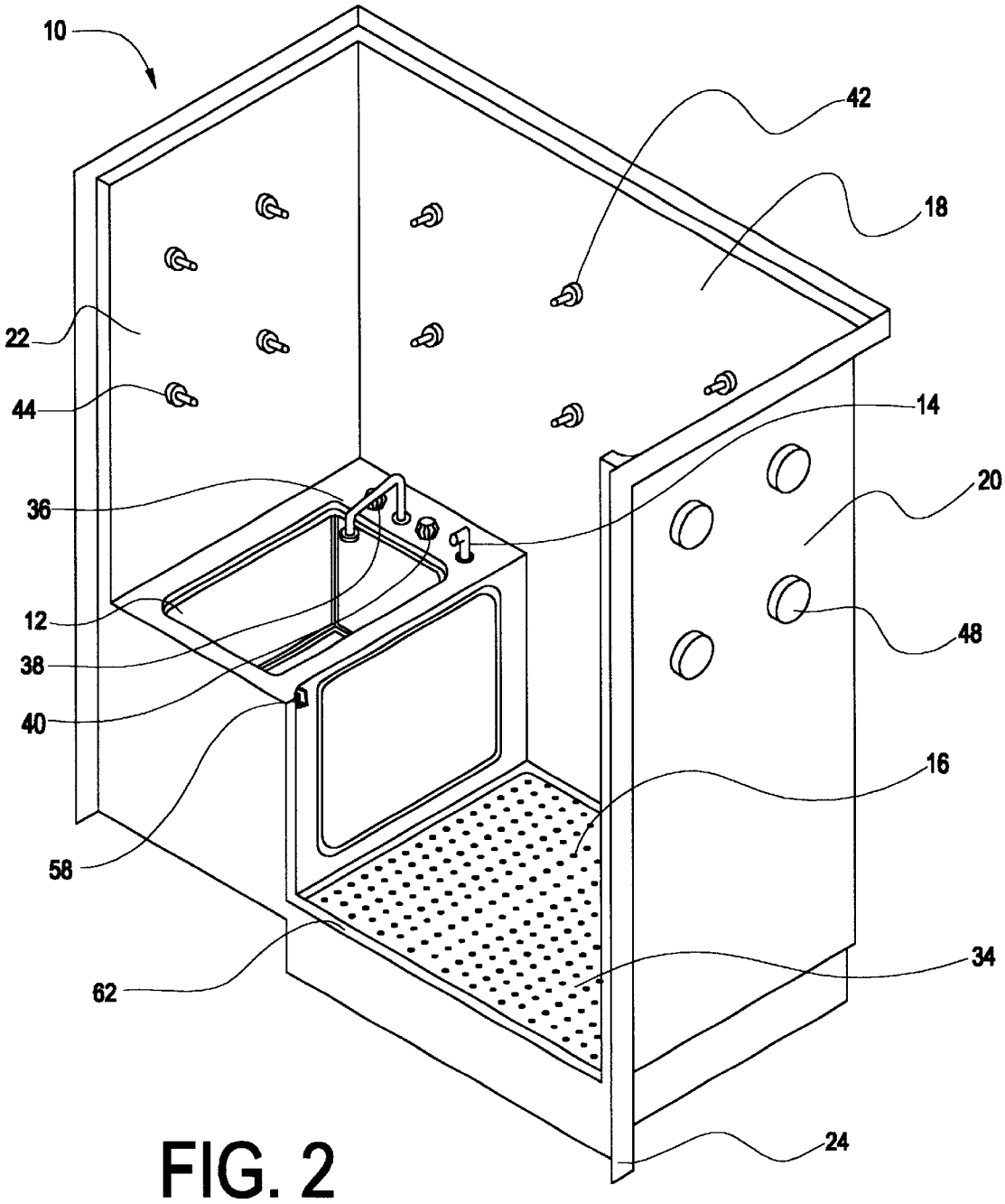
FIG. 2 is an angled perspective view of a preferred embodiment of the invention showing the sink and drain assembly of the present invention with drying racks removed.
Figure 3:
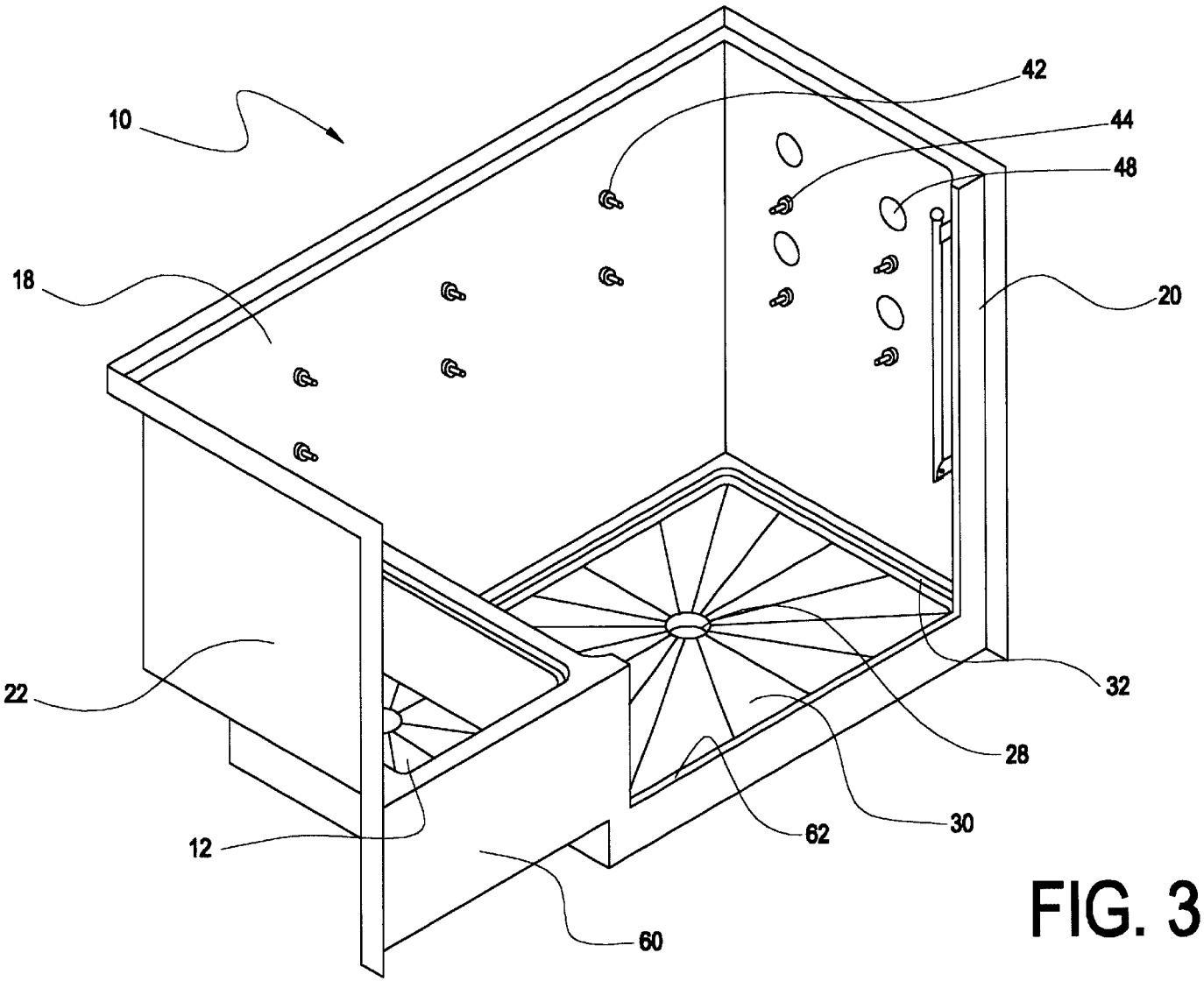
FIG. 3 is an angled perspective view of a preferred embodiment of the invention showing the sink and drain assembly of the present invention with drying racks and floor grate removed.
Figure 4:
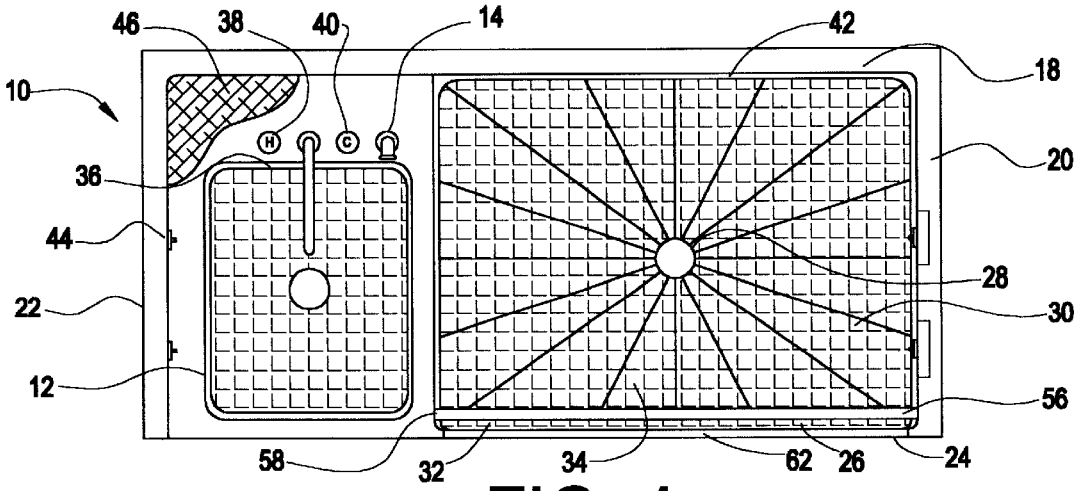
FIG. 4 is a top view of a preferred embodiment of the invention showing the sink and drain assembly of the present invention with a drying rack partially cut away.
Figure 5:
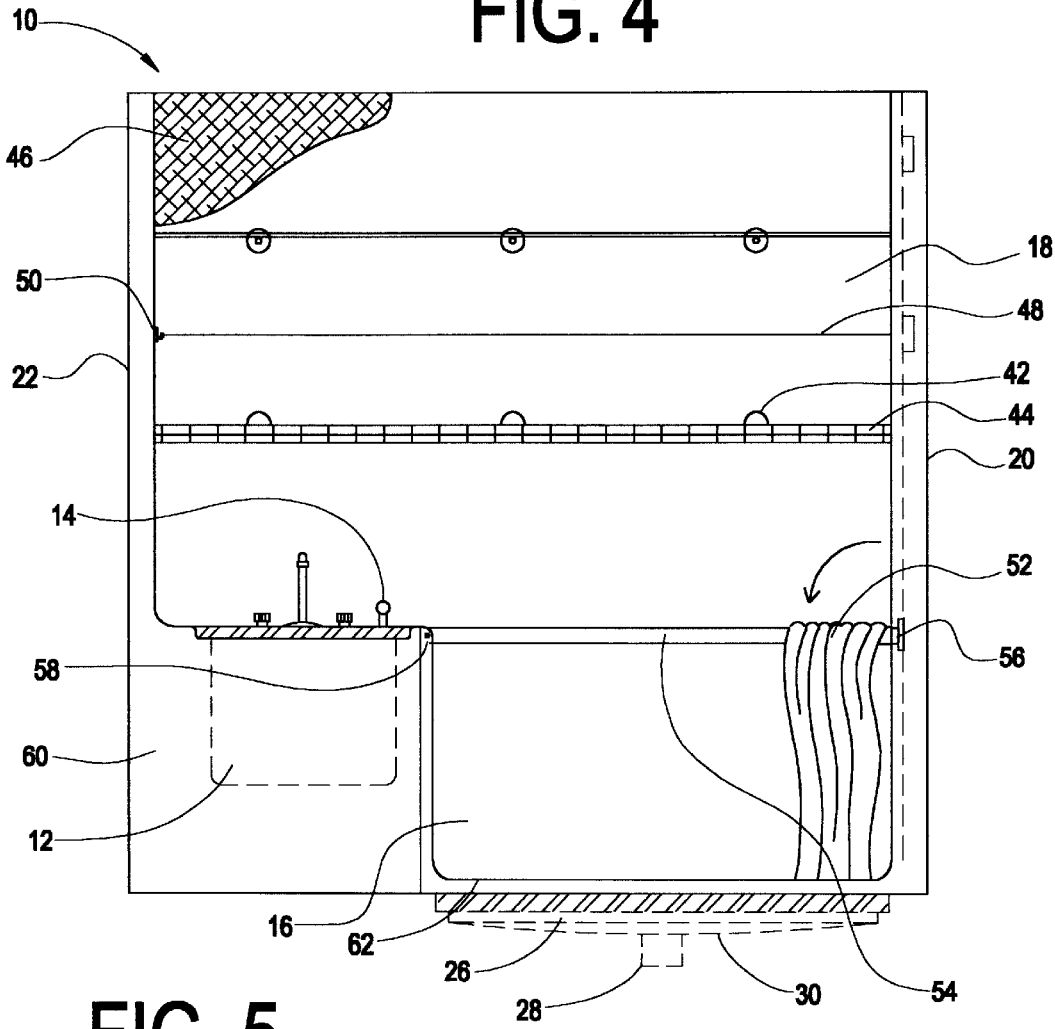
FIG. 5 is a front view of a preferred embodiment of the invention showing the sink and drain assembly of the present invention with a drying rack partially cut away and the curtain retracted.
Figure 6:
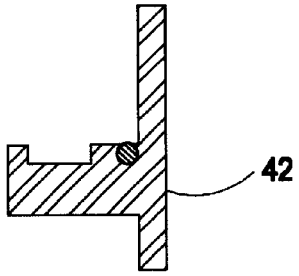
FIG. 6 is a sectional side view of a part of the preferred embodiment of the invention showing a rack support hook of the present invention.
Figure 7:
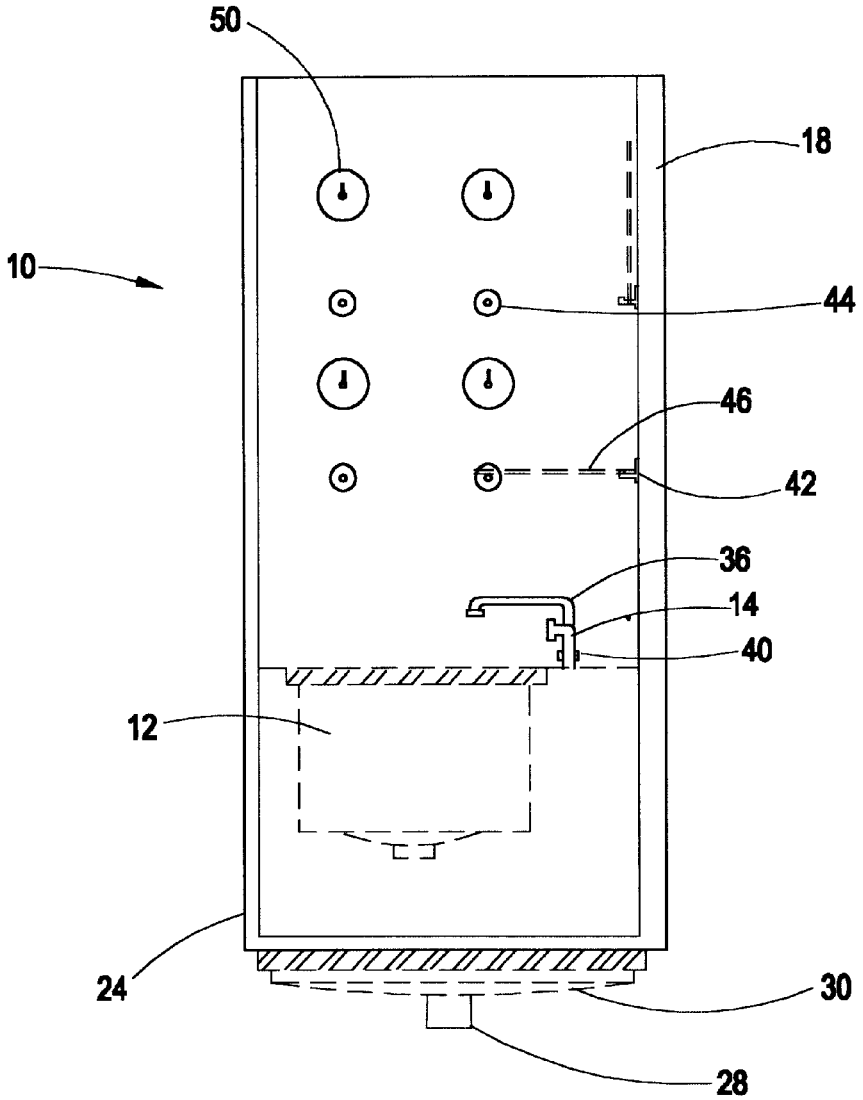
FIG. 7 is a right side view of a preferred embodiment of the invention showing the sink and drain assembly of the present invention with one horizontal and one vertical drying rack.

With reference to the Drawings wherein like numerals represent like parts throughout the Figures., a sink and drained area assembly in accordance with the present invention is generally designated by numeral 10 in FIGS. 1, 2, and 3. Assembly 10 of the present invention employs some features that are similar to or perform similar functions as commonly known features of traditional sink assemblies or shower facilities, such as plumbing and plumbing fixtures. To the extent such features are not specifically or uniquely changed in the design of assembly 10, specific detailed drawings and descriptions of known parts or features will not be provided herein.

Assembly 10 is of overall rectangular prism shape, without a top and a front side. Therefore, assembly 10 comprises an open front 24, a rear wall 18 and side walls 20 and 22. Side walls 20 and 22 are both about two and one half feet in width, and front 24 and rear wall 18 are both about six feet wide in the preferred embodiment. The width of the side walls 20 and 22 cause rear wall 18 to be recessed about average arm's length from the front 24. The front 24 to rear 18 distance may be varied according to the individual preference of the user, including the depth of twenty-four inches to conform with conventional residential cabinetry. Side walls 20 and 22 and rear wall 18 are flat, vertical and formed of a generally impervious material. The assembly 10 comprises a wash sink 12 formed as a part of, or installed on a sink stand 60 at conventional work sink height with appropriate plumbing for a faucet 36, and a sprayer 14, both supplied with hot and cold water, which is controlled by conventional control knobs 38 and 40 and the flow control component of sprayer nozzle 14. Assembly 10 also comprises a drained area 16 immediately and laterally adjacent sink 12, on the right side of sink stand 60. Drained area 16 comprises a rectangular drain pan 26 with a central drain 28 and a floor 30 sloping toward drain 28. A lip 62 protrudes upward from the edge of floor 30 and forms a shoulder 32 raised slightly above the outer edge of floor 30, along the perimeter of entire drained area 16. Shoulder 32 supports a rectangular open floor grate 34 sized to fit within the rectangular area defined and surrounded by lip 62. The preferred material for the body of assembly 10, including sink 12, sink stand 60, drain pan 26 and walls 18, 20, and 22 is fiber reinforced resin. The body of assembly 10 may be formed as an integrated unit that can be molded as one piece.

One or more horizontal rows of three equally spaced upward facing hook shaped rack supports 42 are mounted on the rear wall 18 at heights greater than sink 12. At least one similarly hook shaped rack support 44 is mounted on each of the side walls 20 and 22 at the same height as each row of rear wall hooks 42. For each row of hooks 42 and 44, a rectangular, open grate drying rack 46 is provided, of the same width as the rear wall to extend from one side wall hook 44 to the opposite side wall hook 44. Rear wall hooks 42 are configured to releasably receive the rear lengthwise edge of a drying rack 46 in either the horizontal or vertical position and side wall hooks 44 are 15 configured to releasably receive the side end edge of a drying rack 46 in the horizontal position. Hooks 42 and 44 are useable to hang a variety of items when not in use supporting a drying rack 46. Assembly 10 comprises one or more retractable clothes lines 48 mounted on either side wall 20 or 22, containing a spring loaded line (not shown) extendable to hooks 50 on the opposing side wall 20 or 22.

Drained area 16 is partially enclosable by a retractable curtain 52. A hinged bar 54 extends horizontally from a hinge fitting 56 on side wall 20 to a releasable support fitting 58 mounted on the front corner of the sink stand 60. When engaged in fitting 58, bar 54 extends across the front edge of drained area 16. Curtain 52 is slidingly supported on bar 54 and extendable the length of bar and across the front edge of drained area 16. Hinge 56 allows bar 54 to be raised to a vertical position wall 20. Assembly 10 may be installed with the drain 28 below the level of the floor in the room in which it is installed such that the floor grate is flush or nearly flush with the room floor. The preferred installation would involve only a slight upward protrusion of lip 62 above floor level. An alternative installation would place the position bar 54 may it) realizably engage and be retained by a spring clamp fitting 64 mounted on side entire assembly 10 above the room floor with lip 62 significantly elevated above floor level.

The method of constructing sink and drained area assembly 10 comprises mounting sink 12 on, or forming sink 12 as part of sink stand 60, which is elevated about thirty inches above floor level, and installing or forming drain pan 26 area at or about floor level, laterally and immediately adjacent to the sink stand 60. The method further comprises connecting the sink 12 and drain pan 26 to drainage systems (not shown) and mounting on the sink stand 60 and connecting to the water supply a faucet 36 with flow controls 38 and 40 and a flexible hose (not shown) with attached spray nozzle 14. The drain pan 26 being formed with a central drain 28 and a drain pan floor 30 that slopes downward from the periphery of the drain pan 26 toward the central drain 28. A side wall 20 is formed or installed vertically extending from the sink stand 60 and a side wall 22 is formed or installed vertically extending from the drain pan 26, and a rear wall 18 is formed or installed vertically extending from the rear of sink stand 60 and drain pan 26 and is either molded integrally with, or is connected to side wall 20 and 22 by waterproof joints, the walls being formed of an impervious material. The method comprises either the formation and installation of the sink 12, sink stand 60, the side and rear walls 20, 18, and 22, and drain pan 26 as separate units joined by waterproof seams, or molding the sink 12, sink stand 60, the side and rear walls 20, 18, and 22, and drain pan 26 as a single unit of fiber reinforced resin. The method further comprises the steps of installing a horizontal grate 34 supported above the drain pan floor 30 by the periphery of the drain pan 26 and mounting a plurality of support hooks 42 on the rear and side walls, and releasably supporting from support hooks 42 in a horizontal position at least one drying rack 46 comprising a grate, and pivotally attaching to the front of side wall 20 opposite from sink stand 60, a curtain support rod 54 and mounting on the front of sink stand 60 a support fitting 58 for releasably supporting rod 54, and supporting from rod 54 a retractable curtain 52.

It should be appreciated and anticipated that while the body of assembly 10 has been fabricated as a single molded unit of fiber reinforced resin, other materials, such as plastic, tile or plastic laminates, and other manufacturing and assembly methods could be substituted with similar results.

It should be further appreciated and anticipated that while assembly 10 has been designed with drained area 16 located to the right of sink 12, for the convenience of a right hand dominant user; however, the relative positions of the sink 12 and drained area 16 could be reversed if desired. Similarly, while the height of the curtain 52 is set based on the anticipation that a height of about thirty inches would be most generally convenient, the height can be varied according to expected usage. The number and positions of the drying racks 46, hooks 42 or 44 and clothes lines 48, as well as the overall dimensions and scale of assembly 10 can be varied without departing from the spirit of the present invention and while retaining the benefits thereof.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

I claim:

1. A sink and drained area assembly for installation in a room having a floor, a water supply and drain means, the assembly comprising a sink adapted for fluid connection to the room drain means, and a drained area laterally and immediately adjacent thereto, at or about the level of the floor of the room in which the assembly is installed, comprising a drain pan with a central drain adapted for fluid connection to the room drain means and a drain pan floor that slopes downward from the periphery of the drain pan toward the central drain, and a sink stand on which the sink is supported elevated about thirty inches above the drained area, and a faucet supported by the sink stand and adapted for connection to the water supply and a spray nozzle adapted to provide a high velocity spray and comprising a flow control and a flexible hose connecting the spray nozzle and faucet and long enough to reach every part of the drained area, and a grate and a peripherally extending shoulder, supporting the grate above the drain pan, and a waterproof vertical wall structure extending vertically from the sink stand and from the drain pan partially enclosing the sink and drained area, and a plurality of support hooks mounted on the wall structure and at least one drying rack comprising at least one grate supportable in a horizontal position by the support hooks.

2. The sink and drained area assembly of claim 1, wherein said at least one drying rack is pivotally attached to the wall structure.

3. The sink and drained area assembly of claim 2, further comprising a curtain releasably attached to the sink stand and wall structure extendable across the unenclosed portion of the drained area.

4. The sink and drained area assembly of claim 3, further comprising a curtain support rod releasably attached to the sink stand and pivotally attached to the wall structure.

5. A sink and drained area assembly for installation in a room having a floor, a water supply and drain means, the assembly comprising a sink adapted for fluid connection to the room drain means, and a drained area laterally and immediately adjacent thereto, at or about the level of the floor of the room in which the assembly is installed, comprising a drain pan with a central drain adapted for fluid connection to the room drain means and a drain pan floor that slopes downward from the periphery of the drain pan toward the central drain, and a sink stand on which the sink is supported elevated about thirty inches above the drained area, and faucet supported by the sink stand and adapted for connection to the water supply and a spray nozzle adapted to provide a high velocity spray and comprising a flow control and a flexible hose connecting the spray nozzle and faucet and long enough to reach every part of the drained area, and a grate and a peripherally extending shoulder, supporting the grate above the drain pan, and a waterproof vertical wall structure extending vertically from the sink stand and from the drain pan partially enclosing the sink and drained area, and a curtain releasably attached to the sink stand and wall structure extendable across the unenclosed portion of the drained area.

6. The sink and drained area assembly of claim 5, further comprising a plurality of support hooks mounted on the wall structure and at least one drying rack comprising at least one grate supportable in a horizontal position by the support hooks.

7. The sink and drained area assembly of claim 6, wherein said at least one drying rack is pivotally attached to the wall structure.

8. The sink and drained area assembly of claim 2, further comprising a curtain support rod releasably attached to the sink stand and pivotally attached to the wall structure.

* * * * *